US011231260B2

(12) United States Patent
Schmitz

(10) Patent No.: US 11,231,260 B2
(45) Date of Patent: Jan. 25, 2022

(54) ELECTRONIC SECURING DEVICE

(71) Applicant: RHEINMETALL WAFFE MUNITION GMBH, Unterluess (DE)

(72) Inventor: Juergen Schmitz, Gifhorn (DE)

(73) Assignee: Rheinmetall Waffe Munition GmbH, Unterluess (DE)

( * ) Notice: Subject to any disclaimer, the term of this patent is extended or adjusted under 35 U.S.C. 154(b) by 233 days.

(21) Appl. No.: 16/672,896

(22) Filed: Nov. 4, 2019

(65) Prior Publication Data

US 2020/0064115 A1 Feb. 27, 2020

Related U.S. Application Data

(63) Continuation of application No. PCT/EP2018/060279, filed on Apr. 23, 2018.

(30) Foreign Application Priority Data

May 4, 2017 (DE) ..... 10 2017 109 627.2

(51) Int. Cl.
*F42C 15/44* (2006.01)
*F42C 15/40* (2006.01)

(52) U.S. Cl.
CPC ..... *F42C 15/44* (2013.01); *F42C 15/40* (2013.01)

(58) Field of Classification Search
CPC ..... F42C 15/44; F42C 15/40
See application file for complete search history.

(56) References Cited

U.S. PATENT DOCUMENTS

| | | | | |
|---|---|---|---|---|
| 4,632,032 | A | 12/1986 | Müller | |
| 5,157,222 | A * | 10/1992 | La Mura | F41A 19/68 102/217 |
| 5,756,927 | A | 5/1998 | Fixell et al. | |
| 6,629,498 | B1 | 10/2003 | Marquis | |
| 8,820,241 | B2 | 9/2014 | Kautzsch et al. | |
| 2004/0231547 | A1 | 11/2004 | Keil | |
| 2012/0118190 | A1* | 5/2012 | Fisher | F42C 15/44 102/215 |

(Continued)

FOREIGN PATENT DOCUMENTS

| | | |
|---|---|---|
| DE | 3336534 A1 | 4/1985 |
| DE | 69523637 T2 | 7/2002 |

(Continued)

*Primary Examiner* — J. Woodrow Eldred
(74) *Attorney, Agent, or Firm* — Muncy, Geissler, Olds & Lowe, P.C.

(57) ABSTRACT

An electronic securing device for an electronic load with an energy supply is provided, which can supply the securing device and the load with energy when an input signal is applied for a corresponding time, wherein the electronic securing device has a time delay, which ensures that only signals of a predetermined minimum duration are detected as a signal. The electronic securing device also has a programmable logic, which comprises the time control, and by way of which an operating switch can also be switched on. The programmable logic switches the energy supply to the load for a certain time and switch off again after the time has elapsed. The switching of the energy to the load takes place via a power switch. The switching off of the logic takes place via a first logic switch, which in turn can switch the operating switch and thereby deactivate the logic.

15 Claims, 1 Drawing Sheet

(56) References Cited

U.S. PATENT DOCUMENTS

2015/0253093 A1* 9/2015 Allan ..... F41A 17/06
42/70.06

FOREIGN PATENT DOCUMENTS

| | | | |
|---|---|---|---|
| DE | 102009058718 | A1 | 6/2011 |
| WO | WO 2011/029023 | A1 | 3/2011 |
| WO | WO 2016/026640 | A2 | 2/2016 |

* cited by examiner

ELECTRONIC SECURING DEVICE

This nonprovisional application is a continuation of International Application No. PCT/EP2018/060279, which was filed on Apr. 23, 2018, and which claims priority to German Patent Application No. 10 2017 109 627.2, which was filed in Germany on May 4, 2017, and which are both herein incorporated by reference.

BACKGROUND OF THE INVENTION

Field of the Invention

The present invention relates to an electronic securing device for electronic load securing devices. In the context of the invention at hand, an electronic load is to be securely activated for a certain time and then the energy supply for the electronic load is to be securely deactivated, so that no subsequent activations are possible. In particular, the invention at hand is suitable for fuzes for ammunition and pyrotechnic projectiles. In this case, the load is then the fuze of the ammunition or the pyrotechnic explosive body.

Description of the Background Art

For this purpose, it is known from the prior art to generate a signal by pulse-activated or spin-activated methods, a signal which then supplies the required operating energy to the fuze.

Further, WO 2016/026640 A2 discloses a securing device in which an activation signal is evaluated in order to connect the energy supply to the load by means of a processor. The processor then ensures that after a certain time the energy supply is again disconnected from the load.

In this known type of securing, however, it is not ensured that a renewed ignition occurs by a renewed activation signal. This results in a significant safety risk in particular in ammunition and/or pyrotechnic explosive bodies, because faulty or undetonated ammunition or pyrotechnic explosive bodies involve the risk of still triggering an ignition pulse during their recovery.

SUMMARY OF THE INVENTION

It is therefore an object of the present invention to provide a securing device that enables the most secure ignition possible of the load and securely disconnects the energy supply from the load after ignition, so that no further ignition processes can be triggered. It is likewise an object of the invention at hand to reliably detect an ignition signal and to distinguish it from possibly arising interference signals.

The electronic securing device for an electronic load consists of an energy supply which can supply the securing device and the load with energy. Because this is an electronic securing device, the securing device must be supplied per se via the energy supply and it is suitable further to use the same energy supply for supplying the load. In this case, the load is an electronic load. It is also conceivable to execute the energy supply as a different energy source, for example, a pressure tank for pneumatic controls or a hydraulic tank for hydraulic controls, but an electrical energy supply is preferred.

The electronic securing device further includes a time delay, which ensures that an incoming ignition signal must be present for a certain time in order to be processed uniquely as an ignition signal. Faster pulses or smaller signals are detected by the time delay and, because they were not detected as an ignition signal, do not result in the switching of the energy to the load.

Further, an operating switch and a programmable logic are provided. The operating switch ensures that the energy supply is switched to the programmable logic and the programmable logic can be activated thereby. If the energy is not connected to the logic by means of the operating switch, the programmable logic is in a deactivated state and thus at rest.

The time delay is now provided with an input by way of which signals can be supplied to the time delay. These signals are also preferably electronic signals, but here as well other signal forms can be conceivable. When the input signal is present for a certain time, the time delay now detects that this is to be the activation signal for the load and, when the activation signal is detected, activates the operating switch, which then switches the energy supply to the programmable logic. When energy is applied to the programmable logic, it is activated and integrated into the electronic securing device so that it can switch the energy supply to the load.

Likewise, the programmable logic can control a first logic switch and thus turn it on or off. This first logic switch is now able to switch the operating switch. This means that the activated logic can switch off the operating switch via the first logic switch and thus can interrupt the feeding of the energy supply to the logic. The programmable logic can thereby deactivate itself.

The programmable logic is programmed so that it can turn off the first logic switch and can also supply energy to the load. Likewise, it can interrupt the energy supply from the load. For this purpose, the logic is designed programmable, so that the time during which the load is supplied with energy is freely selectable. After this time has elapsed, the energy supply is then again disconnected from the load and the operating switch is switched off, so that the programmable logic is deactivated. To switch the energy supply to the load, a power switch is required which can also be controlled by the processor.

To ensure the proper functioning of the securing device, it must be ensured that the energy supply is disconnected from the load when the processor is deactivated. Furthermore, it must be ensured that the operating switch can be switched on at any time in order to activate the programmable logic. Upon activation of the programmable logic, the first logic switch must be securely turned on, so that the programmable logic is not immediately deactivated again. Likewise, the programmable logic must ensure that no switching operations are performed after it has been deactivated, as this is the only way to ensure that the first logic switch remains switched and the operating switch cannot turn on a second time.

For a preferred embodiment of the electronic securing device with an electrical energy supply, it is proposed that the switches, therefore, the operating switch, the first logic switch, and the power switch, also be implemented electronically. For this purpose, it is proposed to implement the operating switch as a thyristor and the first logic switch and the power switch as field-effect transistors. The field-effect transistors ensure that the switching is secure and there is no state between on and off, with a simultaneous low energy consumption.

The signal that is to lead to the switching through of the energy supply to the load can be supplied by a sensor to the time delay. This sensor can be tailored to the requirements of the application of the electronic securing device and can be a piezoelectric sensor, a Hall sensor, but also a pressure sensor or setback generator.

In an embodiment, it is proposed to provide an input switch between the sensor and the time delay, said input switch which switches the sensor to the time delay only at a certain sensor signal level. This makes it possible not only to need the signal to be present for a certain time but also to enable a filtering effect for the input signals, so that too small input signals are filtered out from the outset.

Also, a second logic switch can be provided which is disposed between the operating switch and the programmable logic. This makes it possible to supply the programmable logic with the energy supply in a more defined manner, because the logic switch does not have transistor characteristics. In this case, the operating switch controls the second logic switch so that the programmable logic can be supplied with energy via the second logic switch.

Furthermore, an energy limitation can be provided by which the energy of the energy supply to the load is limited.

Due to the double security, the invention at hand fulfills standards corresponding to the securing device of ignition chains and is thus preferably usable for electronic fuzes.

Also provided is an electronic securing method by means of an electronic securing device, wherein first a signal to turn on the energy by the energy supply to the load activates the time delay, wherein the activated time delay connects the energy of the energy supply to the logic by means of the operating switch and thus activates the logic. The activated logic in turn switches the power switch and thus connects the energy of the energy supply to the load for a predefined time. After the predefined time has elapsed, the logic disconnects the energy of the energy supply from the load by means of the power switch and switches the first logic switch in order to switch the operating switch by means of it after the predefined time has elapsed, so that the logic is disconnected from the energy supply and thus deactivated.

A corresponding signal is thus supplied to the time delay and is intended to ensure that the securing device switches the energy of the energy supply to the load. Due to the time delay, the signal must be present for a certain time, so that the activated time delay connects the energy of the energy supply to the logic by means of the operating switch. Therefore, after a certain time of the signal has been detected by the time delay, the time delay activates the operating switch and this switches the energy supply to the logic. The logic is activated thereby and starts the programmable logic program. Likewise, the logic is connected to a power switch and can switch it. In addition, the logic is connected to a first logic switch and can also switch it. By switching the power switch, the energy of the energy supply is connected to the load. The load is activated therewith. The program in the programmable logic is designed so that the power switch only stays on for a certain time. After this time has elapsed, the power switch is turned off again and thus the energy of the energy supply is disconnected from the load again. Also, the first logic switch is switched and causes the operating switch to be turned off. By turning off the power switch, the logic is disconnected from the energy supply and thus deactivated.

The signal by way of which the time delay is activated is preferably generated via a sensor. In a further embodiment, an input switch is provided between the sensor and time delay; it switches only starting at a specific signal strength of the signal and thus signals under the specific signal strength can be filtered out.

The time during which the programmable logic connects the energy supply to the load and the time of the activated logic are freely definable and can be programmed via a program in the programmable logic. Preferably, it must be ensured that when the energy supply to the logic is interrupted, therefore, when the logic is deactivated, the power switch interrupts the energy supply to the load and the first logic switch connects the energy supply to the operating switch, so that it can switch the energy supply to the logic when a signal is present. Only when the switching of the energy supply has already taken place once must the first logic switch remain switched off absolutely to prevent the operating switch from being switched on again.

The above-mentioned double ignition security of fuzes is also ensured by the method, in which, on the one hand, only a defined ignition signal from possibly occurring interference signals can be filtered out and after a single ignition process the interruption to the fuze is interrupted to such an extent that no new ignition pulse can activate the programmable logic and thus the load be activated again.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
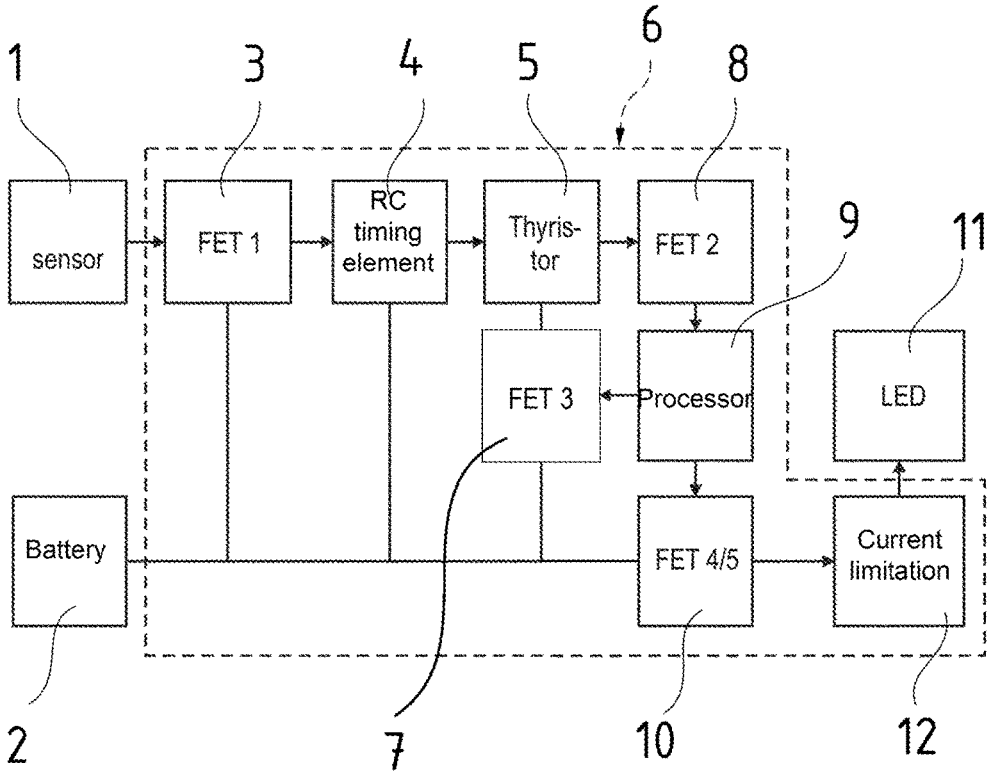
FIG. 1 shows a block diagram of a securing device of the invention.

FIG. 1 shows the electronic securing device 6 of the invention for an electronic load 11. In FIG. 1, an LED is shown as an electronic load 11. Electronic securing device 6 is supplied by a battery as an energy supply 2, wherein energy supply 2 can supply securing device 6 as well as load 11 with energy.

Electronic securing device 6 is now designed so that it can switch on the energy of energy supply 2 to load 11 for a certain time when there is an input signal. After this certain time has elapsed, the energy of energy supply 2 is again disconnected from load 11, namely permanently, so that no further signal can enable the switching of the energy supply to load 11.

The input signal is detected in this case by a sensor 1 and can be electronic, mechanical, or electromagnetic in nature. A setback generator, as it is known in ammunition and projectiles, can also trigger such a signal.

The signal of sensor 1 is switched via an input switch 3 to a time delay 4. Input switch 3 ensures that only signals with a certain signal strength, or level, are detected as an input signal. The time delay ensures that the signal passed through input switch 3 must be present for a certain time in order to be evaluated as an appropriate signal. The combining of input switch 3 and time delay 4 can ensure that a defined signal must be present to trigger a switching operation. Interfering signals or background noise is filtered out by the two elements, input switch 3 and time delay 4.

The signal thus detected is supplied to a power switch 5, which ensures that energy supply 2 is switched to a programmable logic 9 via a second logic switch 8. Programmable logic 9 then executes the program contained therein when energy is applied by energy supply 2.

Programmable logic 9 ensures that the energy of energy supply 2 is switched to load 11 and includes the time function after which load 11 is again disconnected from energy supply 2.

Energy supply 2 is switched to load 11 by a power switch 10, which connects energy supply 2 to load 11. An energy limitation 12, which can limit the energy that is supplied to load 11, can be provided in addition between power switch 10 and load 11. This can be designed, for example, as a current limitation. Energy limitation 12 ensures that no power peaks occur due to the switching of energy supply 2 to load 11 and thus the energy supply 2 is unnecessarily stressed.

After the time programmed in programmable logic 9 has elapsed, logic 9 controls a first power switch 7, which in turn interrupts energy supply 2 to operating switch 5, whereby operating switch 5 is turned off. As a result, energy supply 2 of programmable logic 9 is interrupted, whereby programmable logic 9 stops working.

Due to the now existing configuration of the electronic securing device, energy supply 2 to operating switch 5 is interrupted so that it cannot turn on again. Any subsequent signals detected by sensor 1 can thus no longer lead to the turning on of operating switch 5 and thus no longer to the switching of energy supply 2 to load 11.

Figure 2:
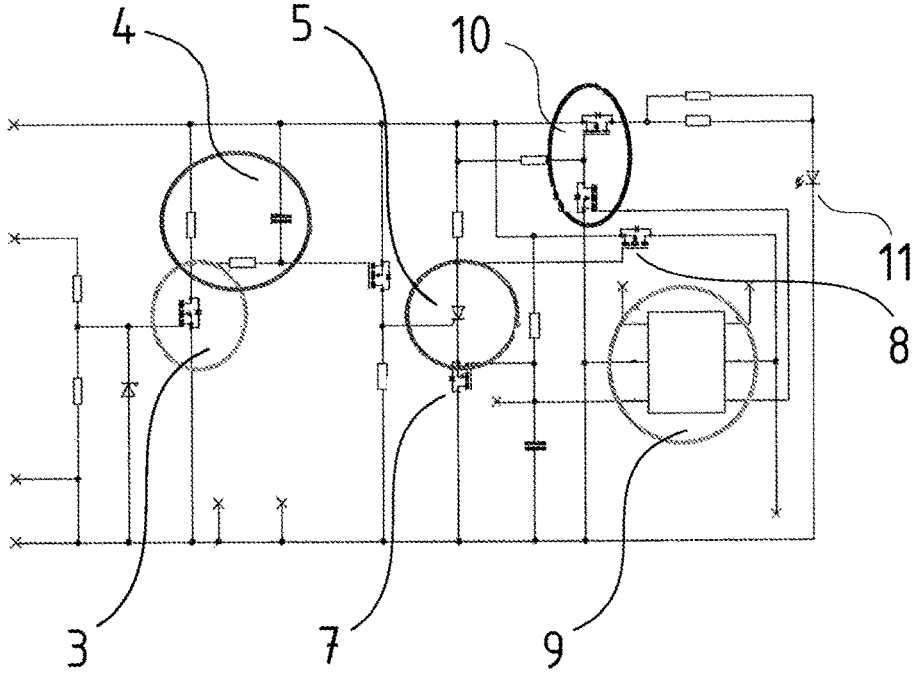
FIG. 2 shows an exemplary electronic circuit diagram of a securing device of the invention.

For this purpose, FIG. 2 shows a possible electronic circuit in which the elements of the block diagram of FIG. 1 can be seen again. Four inputs can be seen on the left side, wherein the outer inputs represent the connections for energy supply 2 and the inner connections the inputs of sensor 1. Energy supply 2 thus supplies the entire electronic securing device 6 with electrical energy.

If a signal is now detected in the input, input switch 3 switches and thus supplies time delay 4 with electrical energy. Time delay 4 is implemented here as an RC combination, so that the capacitor charges itself via the upstream resistors. If the capacitor is provided with sufficient charge, there is a voltage at the input of operating switch 5, which is designed as a thyristor. When a voltage is applied at the thyristor, it switches on and supplies programmable logic 9 with electrical energy via second logic switch 8.

Programmable logic 9 in turn ensures that power switch 10 switches and thus the energy of energy supply 2 reaches load 11. After the time of programmable logic 9 has elapsed, the two FETs, which are provided as power switches, are turned off again, so that the energy supply to load 11 is interrupted. At the same time, programmable logic 9 interrupts the energy supply of operating switch 5, so that the thyristor no longer switches through. This results in an energy interruption to programmable logic 9, as a result of which programmable logic 9 stops working. The last switched state is maintained, so that operating switch 5 cannot turn on once more, because the energy supply of operating switch 5 remains interrupted by first logic switch 7. A second switching on of programmable logic 9 and thus switching of energy supply 2 to load 11 are therefore impossible.

The invention at hand is not limited to the features described above but other embodiments are conceivable. Thus, it is conceivable that, as additional security, the programmable logic memorizes in its internal memory that a switching operation has already been performed and, due to this memorization, is likewise designed so that no further switching operation is performed. This can lead to additional securing. The switches shown above can also be designed as electromechanical switches instead of field-effect transistors, for example, as relays. Likewise, a generator can be provided as an energy supply instead of a battery. In a particular embodiment, it can also be provided that the time delay includes an energy storage means, which takes over the energy supply for the remaining function of the electronic securing device. Due to the energy-saving design of the electronic securing device, such an intermediate storage means is sufficient for a brief moment for supplying the electronic securing device.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An electronic securing device for an electronic load, the device comprising:

an energy supply that supplies the securing device and the load with energy;

a time delay;

an operating switch;

a programmable logic that is adapted to be activated via the operating switch by the time delay;

a power switch to connect or interrupt the energy of the energy supply to the load, wherein the programmable logic is connected to a first logic switch, which switches the operating switch and thus deactivate the programmable logic.

2. The electronic securing device according to claim 1, wherein a sensor is provided, which activates the time delay.

3. The electronic securing device according to claim 2, wherein the sensor is a mechanical, electromagnetic, or setback generator.

4. The electronic securing device according to claim 1, wherein an input switch activates the time delay.

5. The electronic securing device according to claim 1, wherein a second logic switch is provided, via which the energy supply is connectable to the programmable logic.

6. The electronic securing device according to claim 1, wherein an energy limitation is provided, which can limit the energy to the load.

7. The electronic securing device according to claim 1, wherein the programmable logic is a microprocessor or a microcontroller.

8. The electronic securing device according to claim 1, wherein the operating switch is a thyristor.

9. An electronic securing method via an electronic securing device according to claim 1, the method comprising:

activating the time delay via a signal to switch the energy by the energy supply to the load;

connecting, via the activated time delay, the energy of the energy supply to the programmable logic by the operating switch and thereby activating the programmable logic;

switching, via the programmable logic, the power switch and thus connecting the energy of the energy supply to the load for a predefined time;

disconnecting, after the predefined time has elapsed and via the programmable logic, the energy of the energy supply from the load by the power switch; and connecting the programmable logic substantially simultaneously to the first logic switch and, after the predefined time has elapsed, switching the operating switch so that the programmable logic is disconnected from the energy supply and thus deactivated.

10. The electronic securing method according to claim 9, wherein a sensor is provided and the sensor generates the signal which activates the time delay.

11. The electronic securing method according to claim 9, wherein an input switch of the electronic securing device switches only starting at a certain signal strength and thus the signal activates the time delay.

12. The electronic securing method according to claim 9, wherein the time delay is activated only when the signal is applied to the time delay for a predefined time.

13. The electronic securing method according to claim 9, wherein the predefined time is programmed into the programmable logic via a program.

14. The electronic securing method according to claim 9, wherein, when the energy supply to the programmable logic is interrupted, the power switch interrupts the energy supply to the load and the first logic switch connects the energy supply to the operating switch.

15. An Ammunition or projectile comprising an electronic securing device according to claim 1.

* * * * *